US005819144A

United States Patent [19]

Okada et al.

[11] Patent Number: 5,819,144

[45] Date of Patent: Oct. 6, 1998

[54] TONER REPLENISHING DEVICE OF IMAGE FORMING MACHINE

[75] Inventors: Mitsuharu Okada; Toshinori Nishimura, both of Osaka, Japan

[73] Assignee: Mita Industrial Co., Ltd., Osaka, Japan

[21] Appl. No.: 874,526

[22] Filed: Jun. 13, 1997

[30] Foreign Application Priority Data

Jun. 28, 1996 [JP] Japan ..... 8-170187
Jun. 28, 1996 [JP] Japan ..... 8-170188

[51] Int. Cl.[6] ..... G03G 15/08

[52] U.S. Cl. ..... 399/258; 399/262

[58] Field of Search ..... 399/12, 120, 258, 399/262; 222/DIG. 1, 325; 141/346, 347, 351, 352

[56] References Cited

U.S. PATENT DOCUMENTS

| | | | |
|---|---|---|---|
| Re. 34,344 | 8/1993 | Sakato et al. | 399/119 |
| 4,491,161 | 1/1985 | Tamura et al. | 141/364 |
| 4,740,808 | 4/1988 | Kasamura et al. | 399/12 |
| 4,997,016 | 3/1991 | Hacknauer et al. | 141/363 |
| 5,506,665 | 4/1996 | Ishida et al. | 399/119 |
| 5,585,889 | 12/1996 | Shishido et al. . | |
| 5,629,759 | 5/1997 | Jyoroku | 399/262 |

*Primary Examiner*—Robert Beatty
*Attorney, Agent, or Firm*—Beveridge, DeGrandi, Weilacher & Young, LLP

[57] ABSTRACT

A toner replenishing device of an image forming machine, including a toner cartridge receiving member disposed in a machine body and having a cartridge inserting position and a cartridge mounting position; and a toner cartridge having a container body with a toner discharge opening and mounted detachably on the toner cartridge receiving member; wherein a reference alignment mark is provided at a machine body wall portion positioned above the toner cartridge receiving member, a first alignment mark is provided on the container body of the toner cartridge at a position opposite the reference alignment mark at the cartridge inserting position, and a second alignment mark is provided on the container body of the toner cartridge at a position opposite the reference alignment mark at the cartridge mounting position. The cartridge is movable to the cartridge mounting position at right angles to the direction of insertion of the cartridge by using an operating lever.

8 Claims, 8 Drawing Sheets

TONER REPLENISHING DEVICE OF IMAGE FORMING MACHINE

FIELD OF THE INVENTION

The present invention relates to a toner replenishing device of an image forming machine for replenishing a developing device, which is mounted in an image forming machine, such as an electrostatic copier or a laser printer, with a toner as a developer; and a toner cartridge applied thereto.

DESCRIPTION OF THE PRIOR ART

In an image forming machine, such as an electrostatic copier, a laser printer, or an electrostatic facsimile, a developing device is disposed for developing a latent electrostatic image formed on an image bearing member. Such a developing device applies a toner to the latent electrostatic image to develop it to a toner image. Normally, a toner consumed as development proceeds is supplied from a toner cartridge mounted detachably at a required position of the developing device. When the toner in the toner cartridge is used up, the toner cartridge is replaced by a new toner cartridge.

Japanese Patent Publication No. 27906/91 and Japanese Utility Model Publication No. 32688/92 each disclose a toner replenishing device on which a toner cartridge accommodating a toner is detachably mounted. The toner cartridge for use in the toner replenishing device comprises a container body having a toner discharge opening; a shutter member mounted on the container body so as to be capable of reciprocating between a closed position where it covers the toner discharge opening, and an open position where it is displaced from the toner discharge opening; and a flexible belt-shaped seal member coupled at both ends to the container body and surrounding the shutter member in the direction of the reciprocation. Imagine a state before the toner cartridge is mounted in a developing device, and a toner accommodated therein is discharged through the toner discharge opening. In this state before mounting, the shutter member is located at the closed position, and a seal portion of the seal member positioned between the shutter member and the container body is bonded detachably to the container body at the peripheral edge of the toner discharge opening. In this manner, the toner discharge opening is sealed. After the toner cartridge is mounted at a required position of the developing device, the shutter member is advanced manually from the closed position to the open position. In association with this advance of the shutter member, the seal portion of the seal member is peeled from the container body, and displaced from the toner discharge opening to uncover the toner discharge opening. Through the uncovered toner discharge opening, the toner in the container body is discharged suitably. To release the toner cartridge from the developing device for replacement, the shutter member is beforehand returned manually from the open position to the closed position. The seal portion of the seal member moved along with the shutter member in association with its return covers the toner discharge opening again. Thus, the toner remaining in the container body is prevented from falling through the toner discharge opening and scattering to the surroundings, or adhering to the operator's hand, etc.

In the toner replenishing devices described in the aforementioned publications, the shutter member must be advanced manually in order to uncover the toner discharge opening after the mounting of the toner cartridge at a required mounting position of the developing device. Furthermore, the shutter member must be returned manually in order to close the toner discharge opening before releasing the toner cartridge from the developing device. As noted from these facts, operations related to the toner cartridge are tiresome.

As a technology for overcoming the above-described inconveniences, the applicant of the present application proposed in Japanese Patent Application No. 80047/95 a toner replenishing device which includes a toner cartridge receiving member disposed in a machine body and having a cartridge inserting position and a cartridge mounting position provided with a predetermined spacing from the cartridge inserting position; and a toner cartridge mounted detachably on the toner cartridge receiving member; wherein the toner cartridge is inserted into the toner cartridge receiving member at the cartridge inserting position, and can be moved to the cartridge mounting position; and when the toner cartridge is moved from the cartridge inserting position to the cartridge mounting position, the shutter member is advanced relative to the container body to uncover the toner discharge opening, while when the toner cartridge is moved from the cartridge mounting position to the cartridge inserting position, the shutter member is returned relative to the container body to close the toner discharge opening.

If the above-described toner replenishing device lacks a mark when the toner cartridge is to be inserted at the cartridge inserting position of the toner cartridge receiving member, the positioning of the toner cartridge at the inserting position is difficult. It is also difficult to make sure that the toner cartridge has been positioned at the cartridge mounting position without fail, when the toner cartridge has been moved to the cartridge mounting position. The use of the toner cartridge that has not been located securely at the cartridge mounting position would cause the problem of toner scattering to the outside.

With the above toner replenishing device, moreover, the toner cartridge cannot be located at the cartridge mounting position, even when the toner cartridge that has not been situated properly at the cartridge inserting position of the toner cartridge receiving member is moved to the cartridge mounting position. Thus, it is important that the toner cartridge be properly located at the cartridge inserting position of the toner cartridge receiving member. Desirably, the operator should be able to make sure during operation that the toner cartridge be properly located at the cartridge inserting position of the toner cartridge receiving member.

SUMMARY OF THE INVENTION

A first object of the present invention is to provide a toner replenishing device which enables visual confirmation when the toner cartridge is inserted into the cartridge inserting position of the toner cartridge receiving member, and makes it possible to visually confirm that the toner cartridge has been brought to the cartridge mounting position; and a toner cartridge applied thereto.

A second object of the invention is to provide a toner replenishing device which makes it possible to easily detect that the toner cartridge has been properly located at the cartridge inserting position of the toner cartridge receiving member; and a toner cartridge applied thereto.

To attain the first object, the present invention provides a toner replenishing device of an image forming machine, which includes a toner cartridge receiving member disposed in a machine body and having a cartridge inserting position and a cartridge mounting position provided with a predetermined spacing from the cartridge inserting position; and a toner cartridge having a container body with a toner discharge opening and mounted detachably on the toner cartridge receiving member, the container body of the toner cartridge being adapted to be inserted into the toner cartridge receiving member at the cartridge inserting position and to be movable to the cartridge mounting position in a direction at right angles to the direction of the insertion; wherein a reference alignment mark is provided at a machine body wall portion positioned above the toner cartridge receiving member, and a first alignment mark is provided in the container body of the toner cartridge at a position opposite the reference alignment mark at the cartridge inserting position, and a second alignment mark is provided in the container body of the toner cartridge at a position opposite the reference alignment mark at the cartridge mounting position.

The present invention also provides a toner cartridge having a container body with a toner discharge opening and being mounted on a toner cartridge receiving member, the toner cartridge receiving member being disposed in a machine body and having a cartridge inserting position and a cartridge mounting position provided with a predetermined spacing from the cartridge inserting position, the container body of the toner cartridge being adapted to be inserted into the toner cartridge receiving member at the cartridge inserting position and to be moved to the cartridge mounting position in a direction at right angles to the direction of the insertion so as to be brought to the cartridge mounting position; wherein the container body has a first alignment mark provided at a position opposite a reference alignment mark, provided at a machine body wall portion, at the cartridge inserting position, and has a second alignment mark provided at a position opposite the reference alignment mark at the cartridge mounting position.

To attain the second object, the present invention provides a toner replenishing device of an image forming machine, which includes a toner cartridge receiving member disposed in a machine body and having a cartridge inserting position and a cartridge mounting position provided with a predetermined spacing from the cartridge inserting position; and a toner cartridge having a container body with a toner discharge opening and mounted detachably on the toner cartridge receiving member, the container body of the toner cartridge being adapted to be inserted into the toner cartridge receiving member at the cartridge inserting position and to be movable to the cartridge mounting position in a direction at right angles to the direction of the insertion; wherein the container body of the toner cartridge has a guided portion at the bottom thereof, the toner cartridge receiving member has a guide for bearing and guiding the guided portion, and the guide has a stopper portion which engages the guided portion, the stopper portion being provided on the near side of the guide in the direction of insertion of the toner cartridge, and a toner cartridge push means is provided for contacting a rear wall constituting the container body of the toner cartridge and for pushing the toner cartridge to the near side, the toner cartridge push means being provided in the toner cartridge receiving member on the far side in the direction of insertion of the toner cartridge.

The present invention also provides a toner cartridge having a container body with a toner discharge opening and being mounted on a toner cartridge receiving member; the toner cartridge receiving member being disposed in a machine body, having a cartridge inserting position and a cartridge mounting position provided with a predetermined spacing from the cartridge inserting position, having a guide with a stopper portion on the near side in the direction of insertion of the cartridge, and having a toner cartridge push means on the far side in the direction of insertion of the cartridge; and the container body of the toner cartridge being adapted to be inserted into the toner cartridge receiving member at the cartridge inserting position and to be moved in a direction at right angles to the direction of the insertion so as to be brought to the cartridge mounting position; wherein the container body has at the bottom thereof a guided portion to be guided by the guide, and when the container body is inserted into the toner cartridge receiving member, a rear wall constituting the container body contacts the toner cartridge push means, whereupon the pushing force of the toner cartridge push means brings the guided portion into engagement with the stopper portion.

Other technical problems of the present invention, and its concrete measures for solving them will become apparent from the following description.

DETAILED DESCRIPTION OF THE PREFERRED EMBODIMENTS

The present invention will now be described in detail with reference to the accompanying drawings illustrating preferred embodiments of a toner replenishing device and a toner cartridge constructed in accordance with the present invention for use in an image forming machine.

Figure 1:
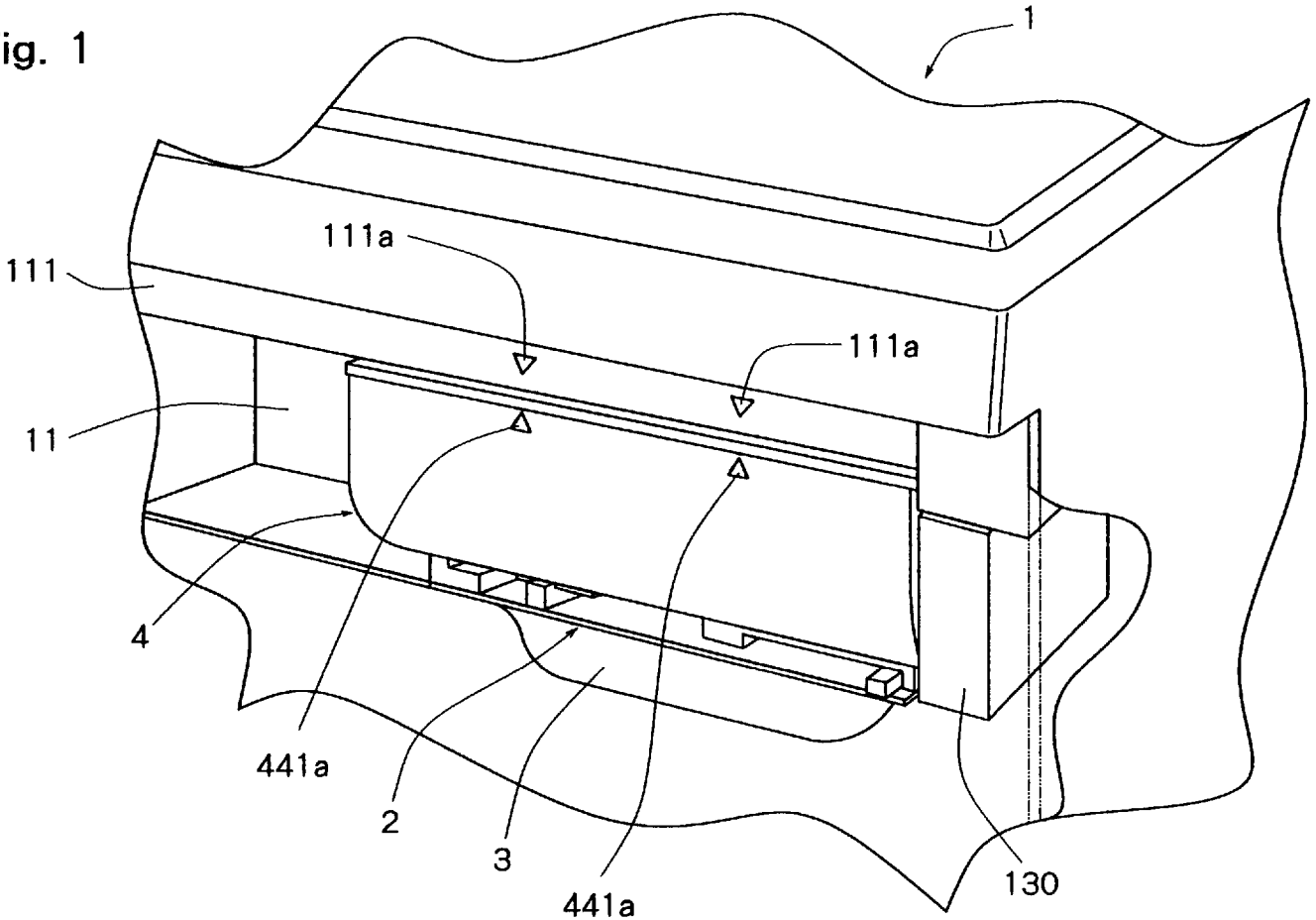
FIG. 1 is an essential part perspective view of an image forming machine equipped with a toner replenishing device constructed in accordance with the present invention.

FIG. 1 is an essential part perspective view showing a state in which a toner cartridge is mounted on a toner cartridge mounting portion of an electrostatic copier. An electrostatic copier 1 shown in FIG. 1 has a toner cartridge mounting portion 11. The toner cartridge mounting portion 11 is composed of a recess provided in an inner cover 111 constituting a front wall of a machine body housing. In the toner cartridge mounting portion 11, a toner cartridge receiving member indicated entirely by the numeral 2 is disposed. A toner cartridge 4 is mounted detachably on this toner cartridge receiving member 2. The inner cover 111 constituting the front wall of the machine body housing is composed of a suitable plastic material. The inner cover 111 has reference alignment marks 111*a*, 111*a* at predetermined positions above the toner cartridge mounting portion 11, namely, above the toner cartridge receiving member 2. These reference alignment marks 111*a*, 111*a* are molded integrally with the inner cover 111, and are suitably colored so as to facilitate visual inspection. Below the toner cartridge receiving member 2, a development housing 3 is disposed. In the development housing 3, a developing means such as a magnetic brush mechanism (not shown) is disposed for performing a developing action designed to apply a toner to a latent electrostatic image to develop it to a toner image.

The toner cartridge receiving member 2 will be described with main reference to FIG. 2.

A toner cartridge receiving be mold 2 which can be molded integrally from a suitable plastic material has a substantially horizontally extending rectangular bottom wall 6. On the bottom wall 6, at a left end part when viewed from the near side of the electrostatic copier 1 (at an upper left end part in FIG. 2), a first guide 8 extending in the direction of insertion of the toner cartridge 4 (the back-and-forth direction) is integrally formed so as to protrude upward. The first guide 8 has a guide surface 8*a* to bear a guided portion (to be described later on) provided in the toner cartridge 4, and a stopper surface 8*b* formed upright from the left end of the guide surface 8*a*, when viewed from the near side of the electrostatic copier 1. On the bottom wall 6, toward the center relative to the first guide 8, a second guide 10 extending in the direction of insertion of the toner cartridge 4 (the back-and-forth direction) is integrally formed so as to protrude upward. The second guide 10 has a guide surface 10*a* formed in a central part thereof for bearing a guided portion (to be described later on) provided in the toner cartridge 4, and stopper surfaces 10*b*, 10*b* formed upright from the front and rear ends of the guide surface 10*a*. The length in the back-and-forth direction of the guide surface 10*a*, i.e., the length between the stopper surfaces 10*b*, 10*b*, is set to be slightly greater than the length in the back-and-forth direction of the guided portion (to be described later on) provided in the toner cartridge 4. In the illustrated embodiment, the guide surface 10*a* is in an uninterrupted shape, but its central part may be removed.

At a rear end part (a far-side end part) toward the center relative to the second guide 10 on the bottom wall 6 constituting the toner cartridge receiving member 2, a toner passage opening 12 is formed. On the left of the toner passage opening 12 and on the rear end side (far side) on the bottom wall 6, an engagement recess 14 is provided which is fitted with an engagement portion of a shutter member (to be described later on) mounted on the toner cartridge 4. This engagement recess 14 functions as a restraining means for restraining the movement of the shutter member (to be described later on). On the right of the toner passage opening 12 on the bottom wall 6, a guide member 16 constituting a third guide is disposed. The guide member 16 has a guide surface 16*a* for bearing a guided portion (to be described later on) provided in the toner cartridge 4, and a first stopper surface 16*b* and a second stopper surface 16*c* that are formed upright from the front end of the guide surface 16*a*. The height of the first stopper surface 16*b* is formed to be nearly the same as the height of the stopper surface 10*b* on the near-side of the second guide 10, while the height of the second stopper surface 16*c* is formed to be larger than the height of the first stopper surface 16*b*. On the underside of the guide member 16, an operating lever 18 is disposed which constitutes a cartridge operating means for moving the toner cartridge 4, borne on the toner cartridge receiving member 2, between a cartridge inserting position and a cartridge mounting position (to be described later on). The operating lever 18 has an end part on its far side supported pivotably by a support pin 20. At a middle part of the operating lever 18, an operating pin 22 is attached so as to protrude upwards. A guide groove 24 is formed in an area where the operating pin 22 moves when the operating lever 18 in the guide member 16 sways with the support pin 20 as a fulcrum.

Figure 3:
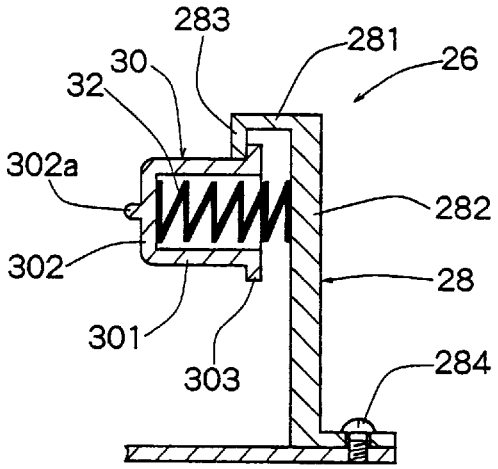
FIG. 3 is a sectional view of a toner cartridge push means mounted on the toner cartridge receiving member shown in FIG. 2.

At the rear end part (the far-side end part) of the bottom wall 6 constituting the toner cartridge 2, two toner cartridge push means 26, 26 are disposed. The toner cartridge push means 26 comprises a support member 28, a push member 30, and a coiled compression spring 32, as shown in FIG. 3. The support member 28 comprises a body 281, a rear wall 282 formed at the rear end of the body 281, and three stopper portions 283 formed at the front end of the body 281. These are integrally molded from a plastic material, and the body 281 is attached to the toner cartridge receiving member 2 by a fastening means such as a machine screw 284. The push member 30 comprises a cylindrical body 301, a front wall 302 formed at the front end of the body 301, and a flange portion 303 formed at the rear end of the body 301, and is assembled such that a front surface of the flange portion 303 is engaged with the stopper portions 283 of the support member 28. At the center of a front surface of the front wall 302 constituting the push member 30, a contact protrusion 302*a* is provided. The coiled compression spring 32 is disposed between the rear wall 282 of the support member 28 and the front wall 302 of the push member 30 to push the push member 30 forward.

The toner cartridge 4 will be described with reference to FIGS. 1, 2 and 4 to 8. The toner cartridge 4 has a container body 42. The container body 42 is composed of a box-shaped main portion 44 open at the top, and a cover portion 46. The main portion 44 and the cover portion 46 may be molded from a suitable plastic material. The cover portion 46 is fixed to the top of the main portion 44 by a suitable securing means, such as bonding or welding, to close the top of the main portion 44. On the top surface of the cover portion 46 that constitutes an upper wall of the container body 42, first alignment marks 46*a*, 46*a* are provided at positions which are opposite the reference alignment marks 111*a*, 111*a* provided in the inner cover 111 constituting the front wall of the machine body housing when the toner cartridge 4 is brought to the inserting position of the toner cartridge receiving member 2. Also at an upper end part of the front surface of the front wall 441 that constitutes the main portion 44 of the container body 42, second alignment marks 441*a*, 441*a* are provided at positions which are opposite the reference alignment marks 111*a*, 111*a*provided in the inner cover 111 constituting the front wall of the machine body housing when the toner cartridge 4 has been set at the mounting position of the toner cartridge receiving member 2.

Figure 5:
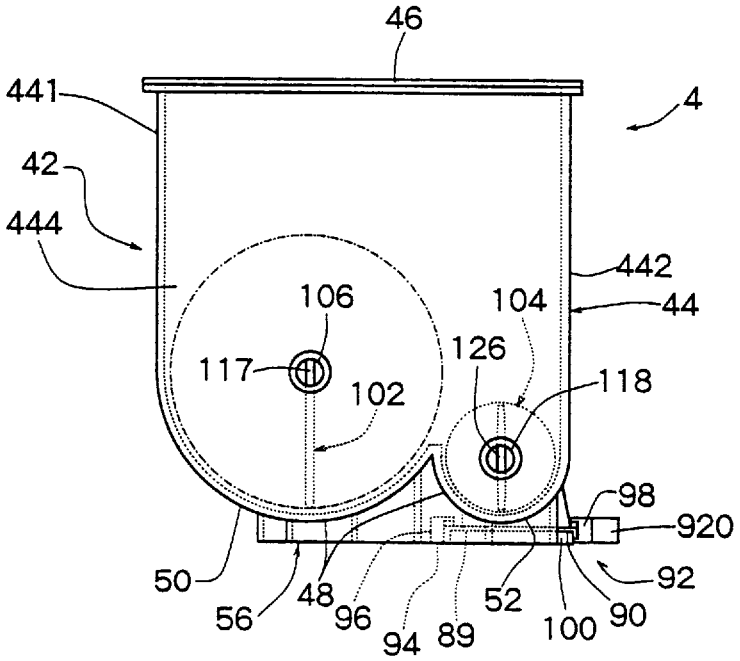
FIG. 5 is a side view of the toner cartridge shown in FIG. 2.
Figure 4:
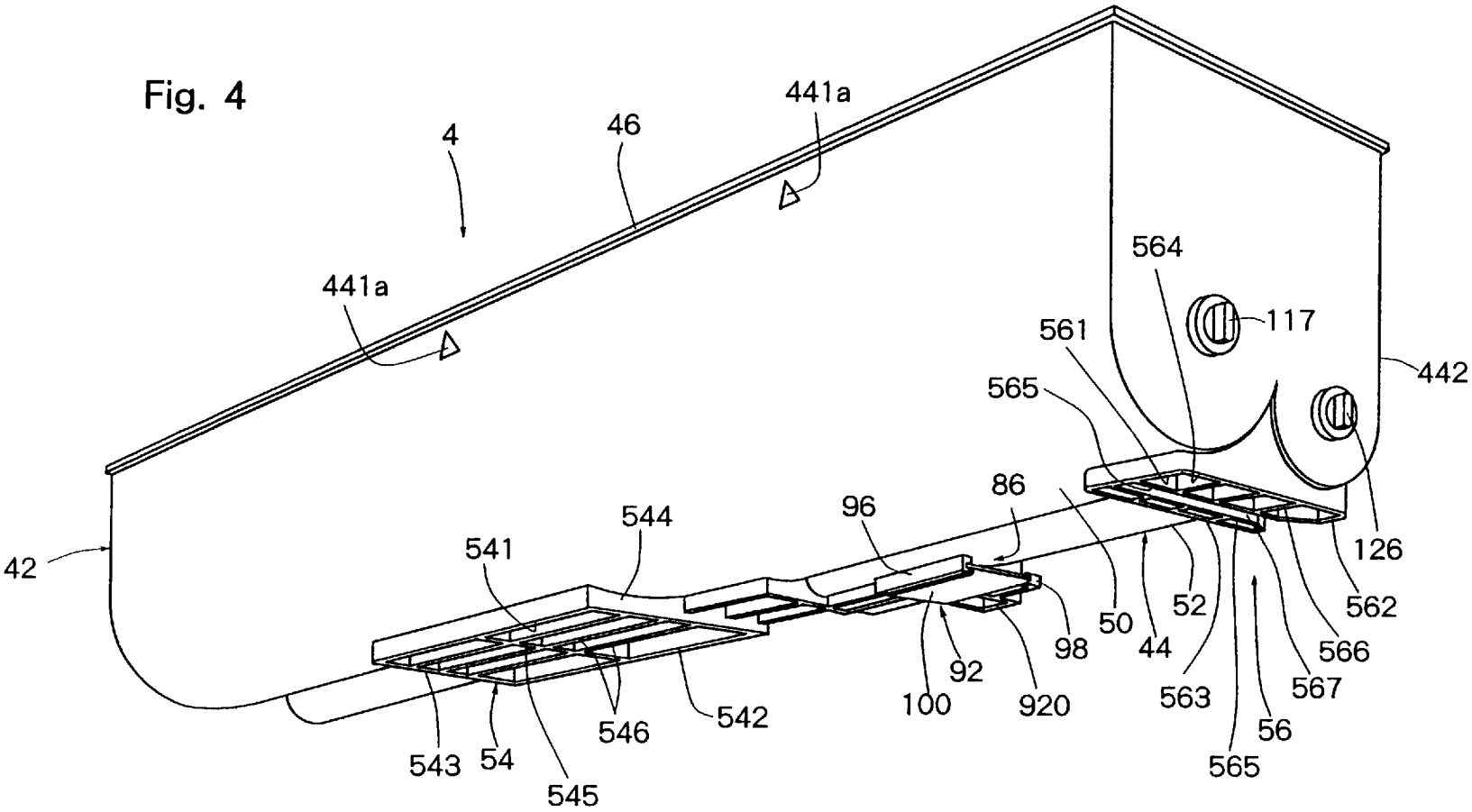
FIG. 4 is a perspective view of the toner cartridge shown in FIG. 2, as viewed from the bottom.

The cross-sectional shape of a front portion 50 in a bottom wall 48 of the main portion 44 constituting the toner cartridge 4 is an arcuate shape with a relatively large radius of curvature as shown in FIG. 5. Whereas the cross-sectional shape of a rear portion 52 is an arcuate shape with a relatively small radius of curvature (however, the rear portion 52 of the bottom wall 48 has a part whose outer surface is not arcuate, but flat in shape, as will be mentioned later on). On a bottom surface, i.e. an outer surface, of the bottom wall 48 constituting the main portion 44 of the toner cartridge 4, a first guided portion 54 and a second guided portion 56 are formed. The first guided portion 54 includes a front ridge 541, a rear ridge 542, a left ridge 543, a right ridge 544, and ridges disposed between them, i.e., a back-and-forth reinforcing ridge 545 and a plurality of right-and-left reinforcing ridges 546. When the toner cartridge 4 is brought to the inserting position of the toner cartridge receiving member 2, the so constructed first guided portion 54 has its left end part borne on the guide surface 8*a* of the first guide 8, and has its middle part borne on the guide surface 10*a* of the second guide 10. Thus, the dimension from the front surface of the front ridge 541 constituting the first guided portion 54 to the rear surface of the rear ridge 542 is slightly smaller than the length between the front and rear stopper surfaces 10*b* and 10*b* of the second guide 10.

The second guided portion 56 includes a front ridge 561, a rear ridge 562, a left ridge 563, a right ridge 564, and ridges disposed between them, i.e., two back-and-forth reinforcing ridges 565, 565 and a plurality of right-and-left reinforcing ridges 566. In the illustrated embodiment, that part of the rear ridge 562 which lies between the two back-and-forth reinforcing ridges 565 and 565 is eliminated. Thus, a guide groove 567 is defined by the two back-and-forth reinforcing ridges 565 and 565. This guide groove 567 is fitted with the operating pin 22 that is provided on the operating lever 18 constituting the cartridge operating means. The thus constructed second guided portion 56 is borne on the guide surface 16*a* of the guide member 16, with the operating pin 22 being fitted into the guide groove 567 from above the first stopper surface 16*b*, when the toner cartridge 4 is put to the inserting position of the toner cartridge receiving member 2.

In the rear portion 52 of the bottom wall 48 of the main portion 46 in the container body 42 constituting the toner cartridge 4, there is a mouth-and-neck portion 86 having an outer surface which is a substantially horizontally extending flat surface. The outer surface, i.e., the lower surface, of the mouth-and-neck portion 86 is preferably substantially coplanar with the lowermost part of the outer surface of the arcuate part in the rear portion 52 of the bottom wall 48. The cross-sectional shape of the inner surface of the mouth-and-neck portion 86 may be arcuate, the same shape as the other part. At the center of the mouth-and-neck portion 86, a rectangular toner discharge opening 88 is formed. On the forward side of the mouth-and-neck portion 86 (the left side in FIG. 5), a mounting rail 89 is formed which protrudes substantially horizontally forward. On the rearward side of the mouth-and-neck portion 86 (the right side in FIG. 5), a mounting rail 90 is formed which protrudes substantially horizontally rearward.

On the mounting rails 89 and 90, a shutter member 92 is mounted so as to be movable widthwise. The shutter member 92, optionally molded from a suitable plastic material, has a rectangular flat plate-like main portion 94, and mounted pieces 96 and 98 formed at the front and rear edges, respectively, of the flat plate-like main portion 94. The mounted piece 96 has an upright part extending upward from the front edge of the flat plate-like main portion 94, and a mounted rail protruding rearward from the upper end of the upright part. The mounted piece 98 has an upright part extending upward from the rear edge of the flat plate-like main portion 94, and a mounted rail protruding forward from the upper end of the upright part. The mounted piece 98 formed at the rear edge of the main portion 94 is provided with an engagement portion 920 formed so as to protrude rearward. The engagement portion 920 is fitted into the engagement recess 14 provided in the toner cartridge receiving member 2, when the toner cartridge 4 is brought to the inserting position of the toner cartridge receiving member 2. Thus, the engagement portion 920 and the engagement recess 14 constitute a restraining means for restraining the movement of the shutter member. The so constructed shutter member 92 is mounted so as to be movable in the width direction of the container body 42, by positioning the mounting rails 89 and 90, formed in the mouth-and-neck portion 86 in the bottom wall 48 of the container body 42, between the front and rear edge parts of the flat plate-like main portion 94 and the mounted rails of the mounted pieces 96 and 98. In a state before the toner cartridge 4 is mounted on the toner cartridge receiving member 2 as will be described later on, the shutter member 92 is located at a closed state indicated by a two-dot chain line in FIG. 8 to cover the mouth-and-neck portion 86 where the toner discharge opening 88 in the bottom wall 48 of the container body 42 is formed.

A seal member 100 is disposed in association with the toner discharge opening 88 and the shutter member 92. The seal member 100, optionally formed from a suitable plastic film, is constructed in the shape of an endless belt by connecting together both ends of a belt-like material. The so constructed seal member 100 surrounds the flat plate-like main portion 94 of the shutter member 92 in the direction of reciprocation of the shutter member 92 (the right-and-left direction in FIG. 8). (In other words, the seal member 100 extends in the direction of forward movement of the shutter member 92, encompassing the inner surface, outer surface and both side edges of the flat plate-like main portion 94.) That seal portion of the seal member 100 which lies between the container body 42 and the shutter member 92 (thus, lies inwardly of the flat plate-like main portion 94 of the shutter member 92) is bonded strippably to the peripheral edge of the toner discharge opening 88 in the bottom wall 48 of the container body 42, namely, to the outer surface of the mouth-and-neck portion 86 in the bottom wall 48 of the container body 42. The strippable bonding of the seal portion in the seal member 100 can be achieved by a suitable means such as welding. As noted above, the opposite ends of the seal member 100 may be directly connected together to make an endless form, so that the shutter member 92 is surrounded by the seal member 100. Instead of this manner, the opposite ends of the seal member may be connected to the mouth-and-neck portion of the bottom wall in the container body, whereby the shutter member is surrounded by the seal member, as disclosed in Japanese Patent Publication No. 27906/91 or Japanese Utility Model Publication No. 32688/92. Instead of surrounding the shutter member by the seal member, it is also possible to connect to the shutter member free ends of fold-back parts extending after being folded back from the seal portions bonded strippably to the mouth-and-neck portion of the bottom wall of the container body in the seal member. As will be seen from the description given later on, however, the manner in which the shutter member 92 is surrounded by the seal member 100 in its reciprocating direction is favorable, since the seal member 100 is also moved over substantially the same length as the length of reciprocation of the shutter member 92. (When the free end of the fold-back part of the seal member is merely coupled to the shutter member, without surrounding the shutter member by the seal member in the direction of its reciprocation, the length of movement of the seal member is a half of the length of reciprocation of the shutter member. This increases the necessary length of forward movement of the shutter member to strip the seal portion of the seal member from the bottom wall in the container body and uncover the toner discharge opening, and the necessary length of return movement of the shutter member to close the toner discharge opening again with the seal portion of the seal member.

Figure 6:
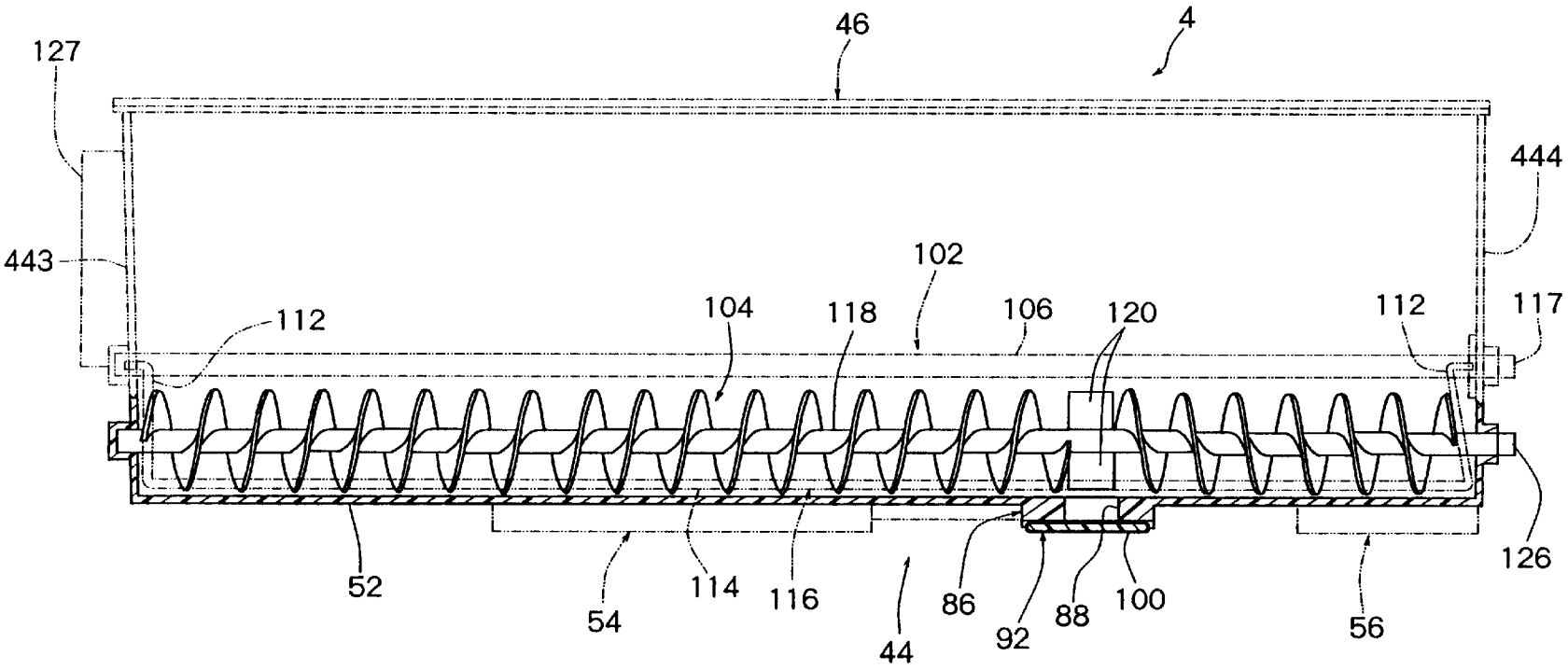
FIG. 6 is a vertical sectional view of the toner cartridge shown in FIG. 2.
Figure 7:
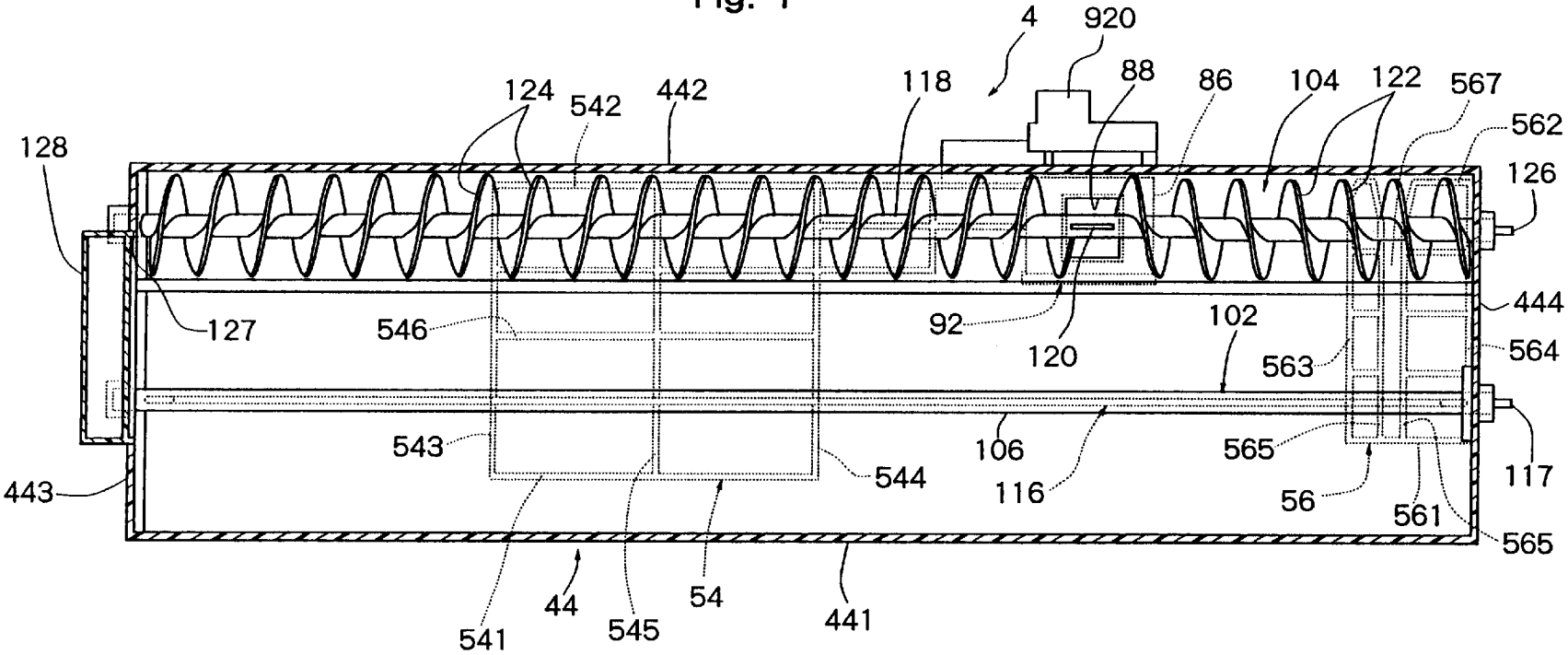
FIG. 7 is a transverse sectional view of the toner cartridge shown in FIG. 2.

In the container body 42 of the toner cartridge 4, a first toner transport mechanism 102 and a second toner transport mechanism 104 are disposed. The first toner transport mechanism 102 has a rotating shaft 106 substantially horizontally extending widthwise above the front portion 50 of the bottom wall 48. The rotating shaft 106 is mounted rotatably between both side walls 443 and 444 in the main portion 44 of the container body 42, and is located substantially in alignment with the center of curvature of the arcuate cross-sectional shape of the front portion 50 of the bottom wall 48. To the rotating shaft 106, there is fixed a transport member 116 having connecting arm portions 112 extending radially from opposite end parts thereof, and a transport portion 114 extending substantially horizontally widthwise between the front ends of the connecting arm portions 112. An end part of the rotating shaft 106 passes through the side wall 444 of the main portion 44 to protrude outward, and a connecting piece 117 is formed at its protruding end. The second toner transport mechanism 104 has a rotating shaft 118 substantially horizontally extending widthwise above the rear portion 52 of the bottom wall 48. The rotating shaft 118 is mounted rotatably between both side walls 443 and 444 in the main portion 44 of the container body 42, and is located substantially in alignment with the center of curvature of the arcuate cross-sectional shape of the rear portion 52 of the bottom wall 48. To the rotating shaft 118, a pair of discharge blades 120, and helical blades 122 and 124 are fixed. The pair of discharge blades 120 are plate-like pieces protruding radially from the rotating shaft 118 at an angular distance of 180 degrees from each other. These discharge blades 120 are positioned above the toner discharge opening 88 in alignment therewith. The helical blade 122 extends between the side wall 108 and the discharge blades 120, while the helical blade 124 extends between the side wall 110 and the discharge blades 120. The direction of helix of the helical blade 122 is reverse to the direction of helix of the helical blade 124. An end part of the rotating shaft 118 passes through the side wall 108 to protrude outward, and a connecting piece 126 is formed on its protruding end surface. The container body 42 of the toner cartridge 4 is filled with a required amount of toner (not shown). A toner can be filled into the container body 42 through a fill opening 127 formed in the side wall 110 (FIGS. 6 and 7). After the toner is filled, a closure member 128 is fixed to the side wall 110 by bonding or welding to close the fill opening.

Figure 9:
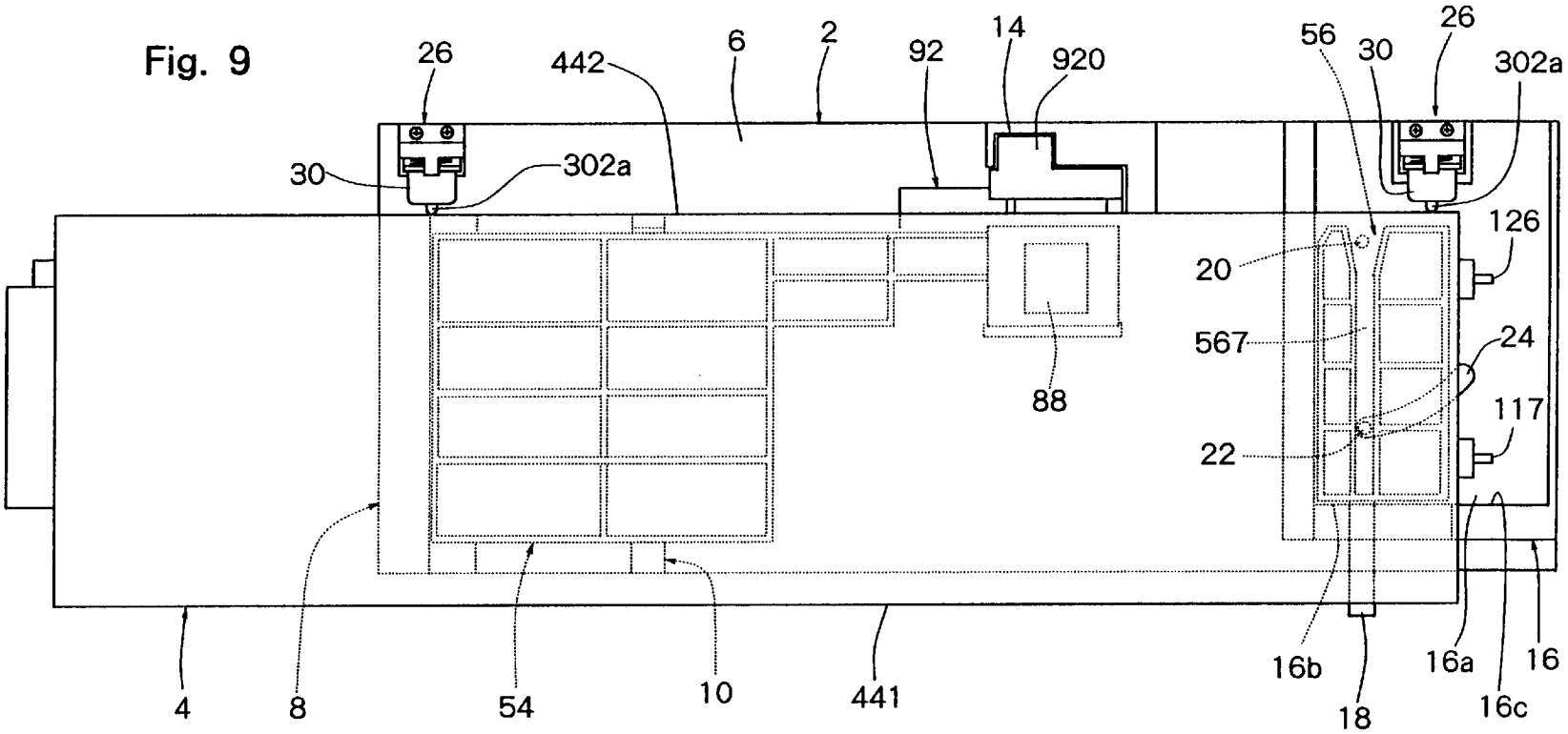
FIG. 9 is an explanatory drawing showing a state in which the toner cartridge is located at a cartridge inserting position of the toner cartridge receiving member shown in FIG. 2.

How to mount and dismount the toner cartridge 4 on and from the toner cartridge receiving member 2 will be described. In mounting the toner cartridge 4 on the toner cartridge receiving member 2, the first alignment marks 46*a*, 46*a* provided on the top surface of the cover portion 46 constituting the toner cartridge 4 are opposed to the reference alignment marks 111*a*, 111*a* provided in the inner cover 111 constituting the front wall of the machine housing, and the toner cartridge 4 is inserted onto the toner cartridge receiving member 2 from the near side to the far side. This position of insertion of the toner cartridge 4 is the inserting position of the toner cartridge receiving member 2. When the toner cartridge 4 has thus been inserted to the far side at the inserting position of the toner cartridge receiving member 2, the rear surface of a rear wall 442 constituting the main portion 44 of the container body 42 of the toner cartridge 4 contacts the contact protrusion 302*a* provided on the front wall 302 that constitutes the push member 30 of the toner cartridge push means 26, as shown in FIG. 9. A further insertion of the toner cartridge 4 causes the push member 30 to recede against the spring force of the coiled compression spring 32. When the toner cartridge 4 has been inserted to a predetermined position, the front ridge 541 of the first guided portion 54 provided in the toner cartridge 4 is positioned deeper than the front stopper surface 10*b* of the second guide 10 provided in the toner cartridge receiving member 2. Furthermore, the front ridge 561 of the second guided portion 56 is positioned deeper than the first stopper surface 16*b* provided in the guide member 16 constituting the third guide. Thus, the near side of the toner cartridge 4 is dropped, so that the first guided portion 54 is laid on the guide surface 8*a* of the first guide 8 and the guide surface 10*a* of the second guide 10, while the second guided portion 56 is laid on the guide surface 16*a* of the guide member 16. At this time, the engagement pin 22 provided on the operating lever 18 is fitted into the guide groove 567 provided in the second guided portion 56. In this situation, the first guided portion 54 and the second guided portion 56 are laid on the guide surface 8*a* of the first guide 8 and the guide surface 10*a* of the second guide 10, and the guide surface 16*a* of the guide member 16, respectively, as noted above. When the force of inserting the toner cartridge 4 is weakened, the toner cartridge 4 is pushed to the near side by the spring force of the coiled compression spring 32 of the toner cartridge push means 26. Consequently, the front ridge 541 of the first guided portion 54 and the front ridge 561 of the second guided portion 56 are contacted with the front stopper surface 10*b* of the second guide 10 and the first stopper surface 16*b* of the guide member 16, and are thereby regulated in terms of position. In this condition, the toner cartridge 4 is located at the inserting position. With the toner cartridge 4 being thus located at the inserting position of the toner cartridge receiving member 2, the engagement portion 920 provided in the shutter member 92 is fitted into the engagement recess 14 provided in the toner cartridge receiving member 2. As described above, when inserting the toner cartridge 4 into the toner cartridge receiving member 2, one may oppose the first alignment marks 46*a*, 46*a*, provided on the top surface of the cover portion 46 constituting the container body 42 of the toner cartridge 4, to the reference alignment marks 111*a*, 111*a*provided in the inner cover 111 constituting the front wall of the machine housing, and then insert the toner cartridge 4 while visually confirming the state of insertion. Thus, the operator can bring the toner cartridge 4 to the inserting position reliably without mistaking the position of insertion. The first alignment marks 46*a*, 46*a* are so provided on the top surface of the cover portion 46 constituting the upper wall of the container body 42 of the toner cartridge 4. Hence, their alignment with the reference alignment marks 111*a*, 111*a* is easy, even when the toner cartridge mounting portion 11 is composed of a recess as in the illustrated embodiment. When the toner cartridge 4 is located at the inserting position, moreover, a decrease in the force of inserting the toner cartridge 4 causes the toner cartridge 4 to be pushed to the near side by the cartridge push means 26. As a result, the front ridge 541 of the first guided portion 54 and the front ridge 561 of the second guided portion 56 are contacted with the front stopper surface 10*b* of the second guide 10 and the first stopper surface 16*b* of the guide member 16, and are thereby restrained in terms of position. The resulting click makes the operator certain that the toner cartridge 4 has been located at the inserting position.

Figure 2:
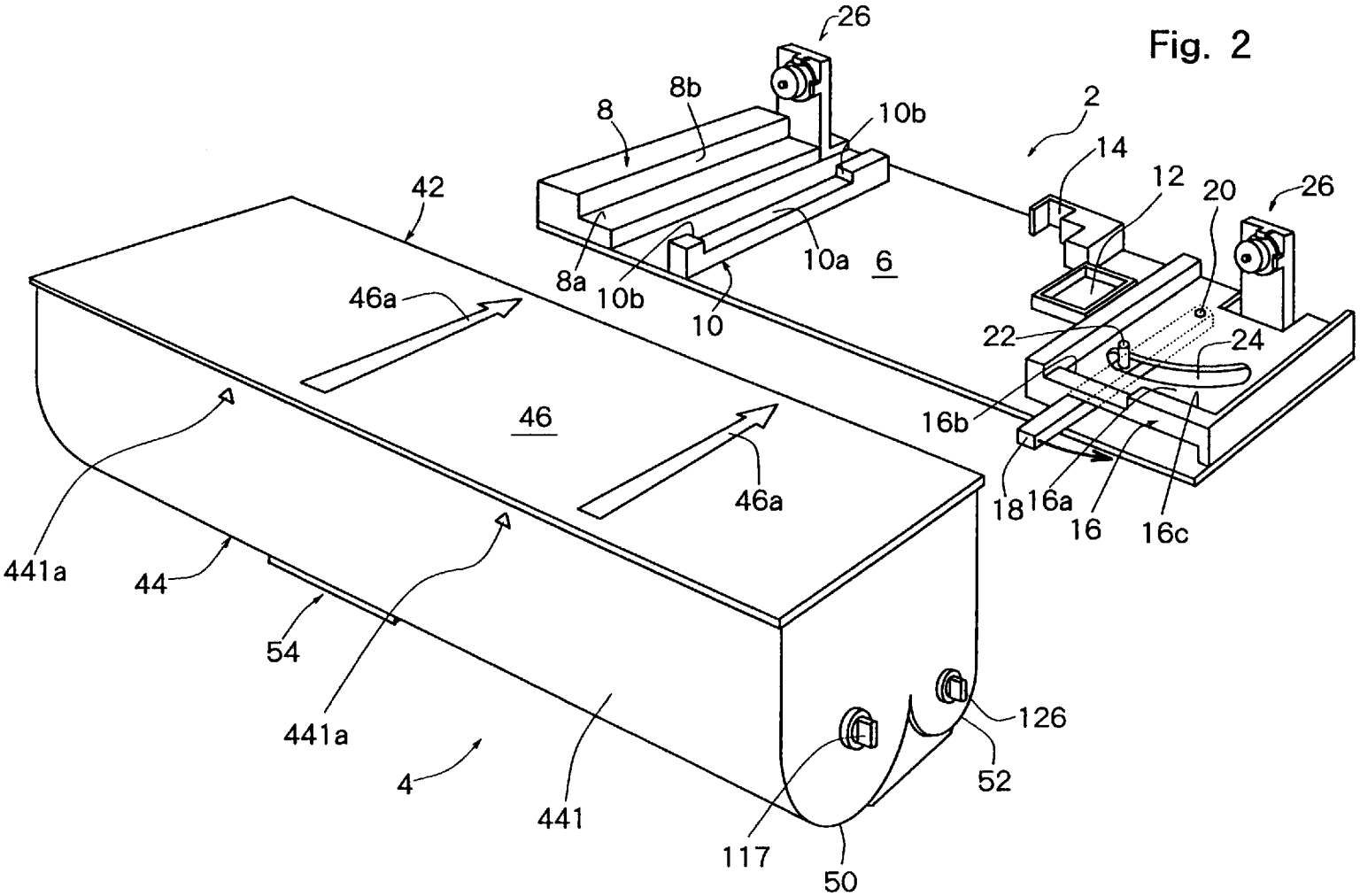
FIG. 2 is an exploded perspective view showing a toner cartridge receiving member and a toner cartridge in a toner replenishing device constructed in accordance with the present invention.
Figure 8:
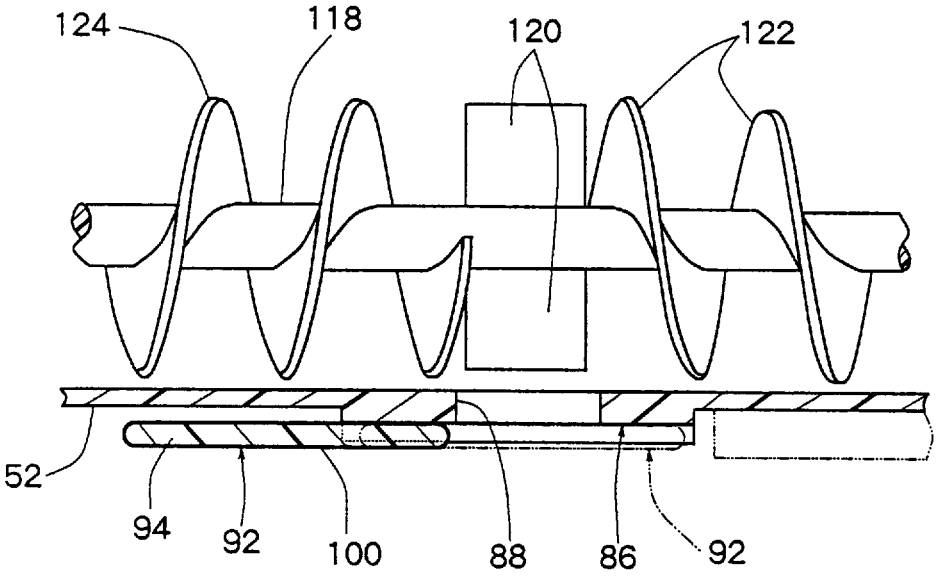
FIG. 8 is a partial sectional view showing a shutter member and a seal member along with a mouth-and-neck portion formed in a container body of the toner cartridge shown in FIG. 2.

After the toner cartridge 4 has been put to a predetermined inserting position, the operating lever 18 constituting the cartridge operating means is turned in the direction of an arrow in FIG. 2 about the support pin 20. By the action of the operating pin 22, the container body 42 of the toner cartridge 4 is moved to a mounting position in a first direction (rightward when viewed from the near side), namely, in a direction at right angles to the inserting direction. While the container body 42 of the toner cartridge 4 is moving, the rear surface of the rear wall 442 is pushed by the push member 30 of the toner cartridge push means 26. However, the contact of the push member 30 with the rear surface of the rear wall 442 is only via the contact protrusion 302*a* provided on the front wall 302. The contact resistance of the contact protrusion 302*a* is so low that the toner cartridge 4 can be moved smoothly. While the container body 42 of the toner cartridge 4 is in the above-mentioned motion from the inserting position to the mounting position in the first direction, the movement of the shutter member 92 is restrained because of its engagement portion 920 fitted into the engagement recess 14 provided in the toner cartridge receiving member 2. As a result, the shutter member 92 is left stationary without being moved. Thus, the shutter member 92 is moved relative to the container body 42 in the direction of advance (leftward when viewed from the near side) from a closed position indicated by a two-dot chain line in FIG. 8 to an open position indicated by a solid line in FIG. 8 (in this open position, the shutter member 92 is displaced from the toner discharge opening 88). As the shutter member 92 moves relative to the container body 42 in the advancing direction, the seal member 100 surrounding the shutter member 92 as shown in FIG. 8 is also moved. The seal portion of the seal member 100 is stripped from the outer surface of the mouth-and-neck portion 86, and displaced from the toner discharge opening 88. Thus, the toner discharge opening 88 is uncovered. The uncovered toner discharge opening 88 aligns with the toner passage opening 12 formed in the bottom wall 6 of the toner cartridge receiving member 2, and lies above it. Hence, the toner accommodated in the container body 42 of the toner cartridge 4 is fed through the toner discharge opening 88 and the toner passage opening 12 into the development housing (not shown) disposed below the toner cartridge receiving member 2. When the container body 42 of the toner cartridge 4 is brought from the inserting position to the mounting position, the second alignment marks 441*a*, 441*a* provided on the front surface of the upper end part of the front wall 441 constituting the container body 42 of the toner cartridge 4 are opposed to the reference alignment marks 111*a*, 111*a* provided in the inner cover 111 constituting the front wall of the machine housing. Thus, the operator can visually make sure that the container body 42 of the toner cartridge 4 has been put to the mounting position. Furthermore, the second alignment marks 441*a*, 441*a* are provided on the front surface of the upper end part of the front wall 441 constituting the container body 42 of the toner cartridge 4. Hence, they can be easily aligned with the reference alignment marks 111*a*, 111*a*, even when the toner cartridge mounting portion 11 is composed of a recess, as in the illustrated embodiment.

When the container body 42 of the toner cartridge 4 has been moved to the mounting position in the foregoing manner, the connecting piece 117 formed at the protruding end of the rotating shaft 106 of the first transport mechanism 102 is drivingly connected to a transmission gear (not shown) in a gear housing 130 (see FIG. 1). The connecting piece 126 formed at the protruding end of the rotating shaft 118 of the second transport mechanism 104 is also drivingly connected to a transmission gear (not shown) in the gear housing 130. Thus, the first transport mechanism 102 and the second transport mechanism 104 become suitably drivable by an electric motor (not shown). The first transport mechanism 102 is rotationally driven counterclockwise in FIG. 5 to convey the toner from a front part to a rear part of the container body 42. The second transport mechanism 104 is rotationally driven clockwise in FIG. 5 such that its helical blades 122 and 124 convey the toner, present at the rear part of the container body 42, widthwise toward the toner discharge opening 88, while its discharge blades 120 discharge the toner through the toner discharge opening 88.

When the toner accommodated in the container body 42 of the toner cartridge 4 has been substantially used up, the toner cartridge 4 is released from the toner cartridge receiving member 2 in the following manner: First, the operating lever 18 constituting the cartridge operating means is moved in a direction reverse to the arrow in FIG. 2 about the support pin 20. By the action of the operating pin 22, the container body 42 of the toner cartridge 4 is moved from the cartridge mounting position to the cartridge inserting position in a second direction (leftward when viewed from the near side). While the container body 42 of the toner cartridge 4 is being moved from the cartridge mounting position to the cartridge inserting position, the movement of the shutter member 92 is restrained as aforementioned. As a result, the shutter member 92 is left stationary without being moved. Thus, the shutter member 92 is moved relative to the container body 42 in the direction of return (rightward when viewed from the near side) from the open position indicated by the solid line in FIG. 8 to the closed position indicated by the two-dot chain line in FIG. 8. Thus, the shutter member 92 covers the toner discharge opening 88. The seal member 100 surrounding the shutter member 92 is also moved in accordance with the motion of the shutter member 92. The seal portion of the seal member 100 is again extended along the outer flat surface of the mouth-and-neck portion 86, so that the toner discharge opening 88 is closed, although not completely. When the container body 42 of the toner cartridge 4 has thus been put to the inserting position, the front end surface of the container body 42 of the toner cartridge 4 is brought upward while being pushed rearward. At this time, the toner cartridge 4 is pushed to the near side by the cartridge push means 26. The front ridge 541 of the first guided portion 54 and the front ridge 561 of the second guided portion 56 pass over the front stopper surface 10*b* of the second guide 10 and the first stopper surface 16*b* of the guide member 16, and pushed out to the near side. Thus, the toner cartridge 4 can be easily withdrawn from the toner cartridge receiving member 2. Normally, some toner is left in the container body 42 of the toner cartridge 4. However, the toner discharge opening 88 is closed by the seal portion of the seal member 100 and the shutter member 92. Thus, the remaining toner is fully prevented from scattering through the toner discharge opening 88 to the surroundings.

The toner replenishing device of an image forming machine and a toner cartridge for use therein in accordance with the present invention are constructed as described above. Thus, they exhibit the following actions and effects:

According to the present invention, the reference alignment mark is provided at a machine body wall portion positioned above the toner cartridge receiving member; the first alignment mark is provided in the container body of the toner cartridge at a position opposite the reference alignment mark at the cartridge inserting position, and the second alignment mark is provided in the container body of the toner cartridge at a position opposite the reference alignment mark at the cartridge mounting position. Thus, when inserting the toner cartridge into the toner cartridge receiving member, the operator may oppose the first alignment mark to the reference alignment mark, and then insert the toner cartridge while visually confirming the state of insertion. Thus, the operator can bring the toner cartridge to the inserting position reliably without mistaking the position of insertion. When the container body of the toner cartridge has been brought from the inserting position to the mounting position, the second alignment mark is opposed to the reference alignment mark. Thus, the operator can visually make sure that the container body of the toner cartridge has been put to the mounting position.

According to the present invention, moreover, when the container body of the toner cartridge is located at the cartridge inserting position of the toner cartridge receiving member, a decrease in the force of inserting the container body after its insertion causes the container body of the toner cartridge to be pushed to the near side by the cartridge push means. As a result, the front end of the guided portion provided in the container body is contacted with the stopper portion of the guide provided in the toner cartridge receiving member, and is thereby restrained in terms of position. The resulting click makes the operator certain that the toner cartridge has been located at the cartridge inserting position.

According to the present invention, furthermore, when the toner cartridge is to be replaced, the container body of the toner cartridge is returned from the cartridge mounting position to the cartridge inserting position. Then, the front end surface of the container body of the toner cartridge is brought upward while being pushed rearward. At this time, the toner cartridge is pushed to the near side by the cartridge push means. The guided portion provided in the container body is passed over the stopper portion of the guide provided in the toner cartridge receiving member, and pushed out to the near side. Thus, the toner cartridge can be easily withdrawn from the toner cartridge receiving member.

What we claim is:

1. A toner replenishing device of an image forming machine, which includes a toner cartridge receiving member disposed in a machine body and having a cartridge inserting position and a cartridge mounting position provided with a predetermined spacing from the cartridge inserting position; and a toner cartridge having a container body with a toner discharge opening and mounted detachably on the toner cartridge receiving member, said container body of the toner cartridge being adapted to be inserted into the toner cartridge receiving member at the cartridge inserting position and to be movable to the cartridge mounting position in a direction at right angles to the direction of the insertion; wherein a reference alignment mark is provided at a machine body wall portion positioned above the toner cartridge receiving member, and a first alignment mark is provided on the container body of the toner cartridge at a position opposite the reference alignment mark at the cartridge inserting position, and a second alignment mark is provided on the container body of the toner cartridge at a position opposite the reference alignment mark at the cartridge mounting position.

2. The toner replenishing device of claim 1, wherein the toner cartridge includes a shutter member mounted on the container body so as to be capable of reciprocating between a closed position where it covers the toner discharge opening, and an open position where it is displaced from the toner discharge opening; and a flexible belt-shaped seal member;

the shutter member is located at the closed position, and a seal portion of the seal member positioned between the container body and the shutter member is bonded strippably to the container body at the peripheral edge of the toner discharge opening, whereby the toner discharge opening is sealed; when the shutter member is advanced from the closed position to the open position, the seal portion of the seal member is stripped from the container body, and displaced from the toner discharge opening to uncover the toner discharge opening; and when the shutter member is returned from the open position to the closed position, the seal portion of the seal member and the shutter member cover the toner discharge opening again; and the toner cartridge receiving member has restraining means for restraining the movement of the shutter member when the container body of the toner cartridge has been positioned at the cartridge inserting position.

3. The toner replenishing device of claim 1, wherein the toner cartridge receiving member has cartridge operating means for moving the toner cartridge between the cartridge inserting position and the cartridge mounting position.

4. The toner replenishing device of claim 1, wherein the first alignment mark is provided on a top wall constituting the container body of the toner cartridge, while the second alignment mark is provided on a front wall constituting the container body of the toner cartridge.

5. A toner cartridge having a container body with a toner discharge opening and being mounted on a toner cartridge receiving member, said toner cartridge receiving member being disposed in a machine body and having a cartridge inserting position and a cartridge mounting position provided with a predetermined spacing from the cartridge inserting position, said container body of the toner cartridge being adapted to be inserted into the toner cartridge receiving member at the cartridge inserting position and to be moved to the cartridge mounting position in a direction at right angles to the direction of the insertion so as to be brought to the cartridge mounting position; wherein a first alignment mark is provided on the container body at a position opposite a reference alignment mark at the cartridge inserting position, said reference alignment mark being provided at a machine body wall portion, and a second alignment mark is provided on the container body at a position opposite the reference alignment mark at the cartridge mounting position.

6. The toner cartridge of claim 5, wherein the first alignment mark is provided on a top wall constituting the container body, while the second alignment mark is provided on a front wall constituting the container body.

7. A toner replenishing device of an image forming machine, which includes a toner cartridge receiving member disposed in a machine body and having a cartridge inserting position and a cartridge mounting position provided with a predetermined spacing from the cartridge inserting position; and a toner cartridge having a container body with a toner discharge opening and mountable detachably on the toner cartridge receiving member, said container body of the toner cartridge being adapted to be inserted into the toner cartridge receiving member at the cartridge inserting position and to be movable to the cartridge mounting position in a direction at right angles to the direction of the insertion; wherein the container body of the toner cartridge has a guided portion at the bottom thereof, the toner cartridge receiving member has a guide for bearing and guiding the guided portion, and cartridge operating means for moving the toner cartridge between the cartridge inserting position and the cartridge mounting position, and the guide has a stopper portion which engages the guided portion, said stopper portion being provided on the near side of the guide in the direction of insertion of the toner cartridge, and toner cartridge push means is provided for contacting a rear wall constituting the container body of the toner cartridge and for pushing the toner cartridge to the near side, said toner cartridge push means being provided in the toner cartridge receiving member on the far side in the direction of insertion of the toner cartridge.

8. The toner replenishing device of claim 7, wherein the toner cartridge includes a shutter member mounted on the container body so as to be capable of reciprocating between a closed position where it covers the toner discharge opening, and an open position where it is displaced from the toner discharge opening; and a flexible belt-shaped seal member;

the shutter member is located at the closed position, and a seal portion of the seal member positioned between the container body and the shutter member is bonded strippably to the container body at the peripheral edge of the toner discharge opening, whereby the toner discharge opening is sealed; when the shutter member is advanced from the closed position to the open position, the seal portion of the seal member is stripped from the container body, and displaced from the toner discharge opening to uncover the toner discharge opening; and when the shutter member is returned from the open position to the closed position, the seal portion of the seal member and the shutter member cover the toner discharge opening again; and the toner cartridge receiving member has restraining means for restraining the movement of the shutter member when the container body of the toner cartridge has been positioned at the cartridge inserting position.

* * * * *